US010170132B2

(12) United States Patent
Kuo et al.

(10) Patent No.: US 10,170,132 B2
(45) Date of Patent: Jan. 1, 2019

(54) ECHO-CANCELLING DEVICE AND ECHO-CANCELLING METHOD

(71) Applicant: AVerMedia Technologies, Inc., New Taipei (TW)

(72) Inventors: Yan-Min Kuo, New Taipei (TW); Hsi-Pang Wang, New Taipei (TW); Yung-Ching Chu, New Taipei (TW); Manu Chen, New Taipei (TW); Yan-Ren Chen, New Taipei (TW); Pin-Feng Chiu, New Taipei (TW)

(73) Assignee: AVERMEDIA TECHNOLOGIES, INC., New Taipei (TW)

( * ) Notice: Subject to any disclaimer, the term of this patent is extended or adjusted under 35 U.S.C. 154(b) by 132 days.

(21) Appl. No.: 15/226,026

(22) Filed: Aug. 2, 2016

(65) Prior Publication Data

US 2017/0040026 A1 Feb. 9, 2017

(30) Foreign Application Priority Data

Aug. 7, 2015 (TW) ..... 104125761 A

(51) Int. Cl.

| | |
|---|---|
| ***G10L 21/0208*** | (2013.01) |
| *H04R 3/04* | (2006.01) |
| *H04R 3/02* | (2006.01) |

(52) U.S. Cl.

CPC ..... *G10L 21/0208* (2013.01); *G10L 2021/02082* (2013.01); *H04R 3/02* (2013.01); *H04R 3/04* (2013.01)

(58) Field of Classification Search

CPC ..... G10L 21/0208; G10L 2021/02082; H04R 3/02; H04R 3/04

See application file for complete search history.

(56) References Cited

U.S. PATENT DOCUMENTS

| | | | | |
|---|---|---|---|---|
| 9,336,767 | B1 * | 5/2016 | Barton | G10K 11/16 |
| 9,373,318 | B1 * | 6/2016 | Piersol | G10K 11/175 |
| 2005/0099967 | A1 * | 5/2005 | Baba | H04B 3/23 370/286 |
| 2009/0067637 | A1 * | 3/2009 | Gollbach | H04M 9/085 381/66 |
| 2009/0252343 | A1 * | 10/2009 | Mao | H04M 9/082 381/66 |

* cited by examiner

*Primary Examiner* — Nafiz E Hoque

(74) *Attorney, Agent, or Firm* — McClure, Qualey & Rodack, LLP

(57) ABSTRACT

An echo-cancelling device includes an audio input/output (I/O) terminal, an audio-receiving module, an analog-to-digital (A/D) converter, and a processor is provided. The A/D converter is electrically connected to the audio-receiving module. The processor is electrically connected to the A/D converter and the audio I/O terminal. The audio I/O terminal receives an external reference signal from an electronic device. The audio-receiving module receives an input audio and an output audio from the electronic device, and generates an analog input signal having the input audio and the output audio. The A/D converter generates a digital input signal according to the analog input signal. The processor cancels the output audio to generate a second (digital) sound signal according to the digital input signal and the external reference signal. Finally, the processor transmits the second (digital) sound signal to the electronic device via the audio I/O terminal.

10 Claims, 4 Drawing Sheets

ECHO-CANCELLING DEVICE AND ECHO-CANCELLING METHOD

CROSS REFERENCE TO RELATED APPLICATIONS

This Non-provisional application claims priority under 35 U.S.C. § 119(a) on Patent Application No. 104125761 filed in Taiwan, Republic of China on Aug. 7, 2015, the entire contents of which are hereby incorporated by reference.

BACKGROUND

1. Technical Field

The disclosure relates to an echo-cancelling device and echo-cancelling method, in particularly, to an echo-cancelling device and echo-cancelling method to cancel the echo generated from an electronic device.

2. Description of Related Art

With the advancement of the technology, people can communicate to each other by audio or video through various kinds electronic device, for example computers, portable devices or smart appliances.

For example, a user A is communicating to a user B by a first electronic device, which has a first speaker and a first microphone. The first microphone of the first electronic device is receiving the voice of the user A and may receive the sound of the user B delivered through the first speaker of the first electronic device when the user A is making a voice call with the user B. The echo phenomenon occurs when the voice and the sound are to be repeatedly sent and received so that the use A feels uncomfortable. Similarly, the echo phenomenon may occur in the user B.

It is therefore an important subject of the invention to provide an echo-cancelling device and an echo-cancelling method to solve the echo phenomenon without modifies the original electronic device.

SUMMARY OF THE INVENTION

In view of the foregoing, the invention is to provide an echo-cancelling device and an echo-cancelling method to solve the echo phenomenon occurs in an electronic device, which the echo-cancelling device is externally connected to the electronic device.

To achieve the above, an echo-cancelling device of the invention, which is used for electrically connected to an electronic device, includes an audio input-output (I/O) terminal, an audio-receiving module, an analog-to-digital (A/D) converter and a processor. The electronic device generates an output signal, an external reference signal and an output audio. The output signal and the external reference signal are generated according to a first sound signal. The output audio is generated according to the output signal. The audio I/O terminal receives the external reference signal. The audio-receiving module receives an input audio and the output audio, and generates an analog input signal with the input audio and the output audio. The A/D converter is electrically connected to the audio-receiving module to receive the analog input signal, and generates a digital input signal according to the analog input signal. The processor is electrically connected to the A/D converter and the audio I/O terminal to receive the external reference signal via the audio I/O terminal and to receive the digital input signal from the A/D converter so as to cancel the output audio. In addition, the processor generates a second sound signal, which is transmitted to the electronic device via the audio I/O terminal.

In general, the output signal can be an analog output signal or a digital output signal, the first sound signal can be a first analog sound signal or a first digital sound signal, and the second sound signal can be a second analog sound signal or a second digital sound signal that the necessary element corresponding to the different signal type is well known to those skilled in the art. In the present application, the output signal is an analog output signal, the first sound signal is a first digital sound signal, and the second sound signal is a second digital sound signal.

To achieve the above, an echo-cancelling method of the invention is applied with the electronic device of the previous paragraph. The echo-cancelling method includes the steps of receiving the external reference signal; receiving an input audio and the output audio; generating an analog input signal with the input audio and the output audio; receiving the analog input signal; generating a digital input signal according to the analog input signal; receiving the digital input signal; cancelling the output audio according to the digital input signal and the external reference signal; generating a second sound signal; and transmitting the second sound signal to the electronic device.

To achieve the above, an echo-cancelling device of the invention, which is used for electrically connected to an electronic device, includes an audio output terminal, an audio input terminal, an audio-receiving module, at least an A/D converter and a processor. The electronic device generates an output signal according to a first sound signal, and an output audio according to the output signal. The audio input terminal receives the output signal. The audio-receiving module receives an input audio and the output audio, and generates an analog input signal with the input audio and the output audio. The A/D converter is electrically connected to the audio-receiving module and the audio input terminal to receive the analog input signal and the output signal, and to generate a digital input signal according to the analog input signal and an external reference signal according to the output signal. The processor is electrically connected to the A/D converter to receive the digital input signal and the external reference signal so as to cancel the output audio and generate a second sound signal according to the digital input signal for transmitting to the electronic device.

In one embodiment, the echo-cancelling device further includes a D/A converter. The D/A converter is electrically connected to the processor and the audio output terminal to receive the second sound signal so as to generate an analog sound signal for transmitting to the electronic device via the audio output terminal.

In general, the output signal can be an analog output signal or a digital output signal, the first sound signal can be a first analog sound signal or a first digital sound signal, and the second sound signal can be a second analog sound signal or a second digital sound signal that the necessary element corresponding to the different signal type is well known to those skilled in the art. In the present application, the output signal is an analog output signal, the first sound signal is a first digital sound signal, and the second sound signal is a second digital sound signal.

To achieve the above, an echo-cancelling method of the invention is applied with the electronic device of the previous paragraph. The echo-cancelling method includes the steps of receiving the output signal; receiving an input audio and the output audio; generating an analog input signal with the input audio and the output audio; receiving the analog input signal; generating a digital input signal according to the analog input signal; generating an external reference signal according to the output signal; cancelling the output audio according to the digital input signal and the external reference signal; generating a second sound signal; receiving the second sound signal; generating an analog sound signal according to the second sound signal; and transmitting the analog sound signal to the electronic device.

As mentioned above, the echo-cancelling device is an external connection type device to connect to the electronic device. The echo-cancelling device generates the sound signal, which is obtained by calculating the input audio, output audio and the external reference signal, to transmit to the electronic device. Therefore, the users may cancel the echo phenomenon without to modify the conventional electronic device.

The detailed technology and preferred embodiments implemented for the subject invention are described in the following paragraphs accompanying the appended drawings for people skilled in this field to well appreciate the features of the claimed invention.

BRIEF DESCRIPTION OF THE DRAWINGS

The parts in the drawings are not necessarily drawn to scale, the emphasis instead being placed upon clearly illustrating the principles of at least one embodiment. In the drawings, like reference numerals designate corresponding parts throughout the various diagrams, and all the diagrams are schematic.

DETAILED DESCRIPTION

Figure 1:
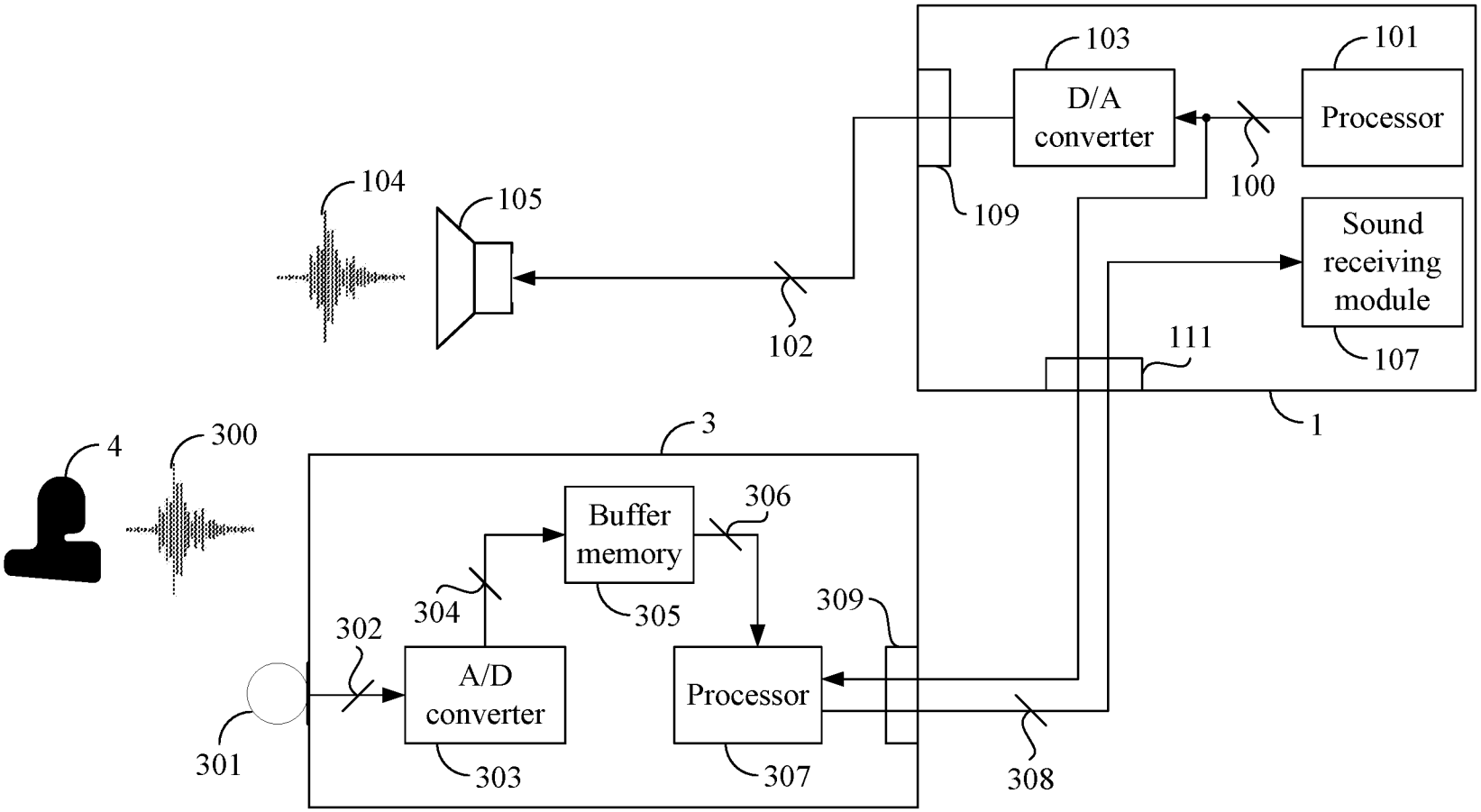
FIG. 1 is a schematic diagram showing an echo-cancelling device applied with an electronic device according to a first embodiment of the invention.

The parts in the drawings are not necessarily drawn to scale, the emphasis instead being placed upon clearly illustrating the principles of at least one embodiment. In the drawings, like reference numerals designate corresponding parts throughout the various diagrams, and all the diagrams are schematic.

FIG. 1 is a schematic diagram showing an echo-cancelling device 3 electrically connected to an electronic device 1. The electronic device 1 includes a processor 101, a digital-to-analog (D/A) converter 103, a speaking module 105, a sound-receiving module 107, an audio output terminal 109 and an audio input/output (I/O) terminal 111. The processor is electrically connected to the D/A converter 103. The D/A converter 103 is electrically connected to the speaking module 105 via the audio output terminal 109. The electronic device 1 may be a smart phone, a personal digital assistant (PDA), a desktop, a laptop or a television.

Referring to FIG. 1, the echo-cancelling device 3 according to the first embodiment includes an audio-receiving module 301, an analog-to-digital (A/D) converter 303, a buffer memory 305, a processor 307 and an audio I/O terminal 309. The audio-receiving module 301 is electrically connected to the A/D converter 303. The A/D converter 303 is electrically connected to the buffer memory 305. The processor 307 is electrically connected to the buffer memory 305 and the audio I/O terminal 309. In other words, the processor 307 is electrically connected to the A/D converter 303 via the buffer memory 305. The audio I/O terminal 309 of the echo-cancelling device 3 is electrically connected to the audio I/O terminal of the electronic device 1. In other words, the echo-cancelling device 3 is electrically connected to the electronic device 1 via the audio I/O terminal 111 and 309. The audio-receiving module 301 may be a microphone or any sound capturing with the same function and well known to those skilled in the art. The audio I/O terminal 111 and 309 may be an universal serial bus (USB) terminal, a high definition multimedia interface (HDMI) terminal, a Thunderbolt terminal, a IEEE 1394 terminal, an external PCI Express terminal or any digital transmission with the same function and well known to those skilled in the art.

The operating procedure of the electronic device 1 is described as following. Referring to FIG. 1, a first digital sound signal 100 is generated by the processor 101 when a sound is delivered from the electronic device 1, and then the first digital sound signal 100 is transmitted to the D/A converter 103 and the audio I/O terminal 111. An external reference signal 106 is generated according to the first digital sound signal 100 when the audio I/O terminal 111 received, and then the external reference signal 106 is transmitted to the echo-cancelling device 3. An analog output signal 102 is generated according to the digital sound signal 100 when the D/A converter 103 receives the first digital sound signal 100, and then the analog output signal 102 is transmitted to the speaking module 105 via the audio output terminal 109. Finally, the speaking module 105 generates an output audio 104 according to the analog output signal 102.

The operating procedure of a user 4 using the echo-cancelling device 3 to transmit the sound to the electronic device 1 is described as following. Referring to FIG. 1, when the user 4 generates an input audio 300, the audio-receiving module 301 receives the input audio 300 and the output audio 104, which is generated by the speaking module 105, simultaneously so as to generate an analog input signal 302 with the input audio 300 and the output audio 104. The analog input signal 302 is transmitted to the A/D converter 303. It should be noted, the analog input signal 302 further has other noise including background audio.

The A/D converter 303 is to generate a digital input signal 304 according to the analog input signal 302, and to transmit the digital input signal 304 to the buffer memory 305. The buffer memory 305 is to delay the digital input signal 304 to generate a delayed digital input signal 306, and then the delayed digital input signal 306 is transmitted to the processor 307. The processor 307 receives the delayed digital input signal 306 and the external reference signal 106, which is transmitted by the audio I/O terminal 111 of the electronic device 1 via the audio I/O terminal 309. The processor 307 is to cancel the output audio 104 according to the delayed digital input signal 306 and the external reference signal 106, and to generate a second digital sound signal 308. The second digital sound signal 308 is transmitted to the electronic device 1 via the audio I/O terminal 309.

Finally, the sound-receiving module 107 of the electronic device 1 receives the second digital sound signal 308 from the audio I/O terminal 309 of the echo-cancelling device 3.

Figure 2:
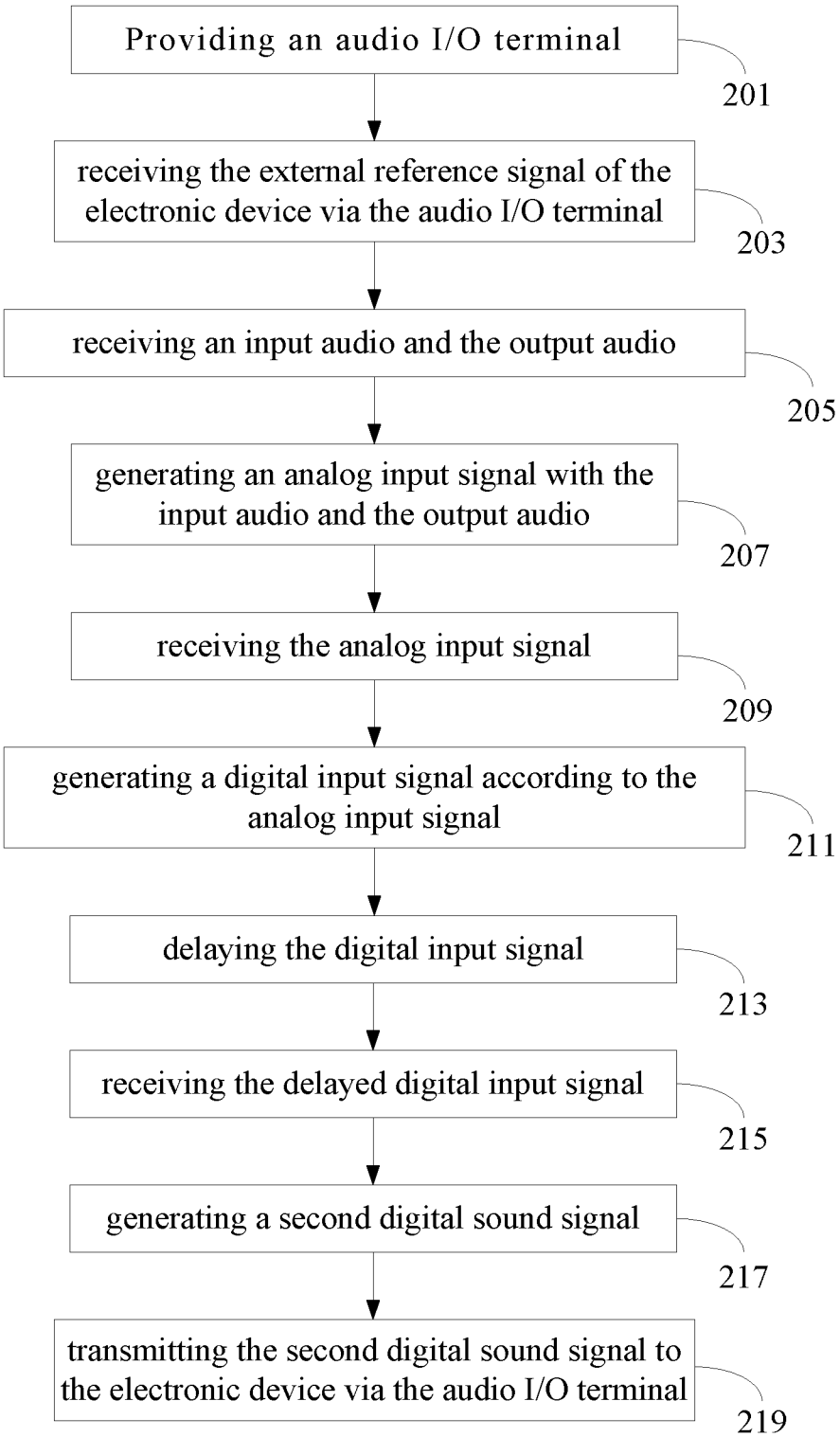
FIG. 2 is a flow chart showing an echo-cancelling method according to a second embodiment of the invention.

FIG. 2 is a flow chart showing the echo-cancelling method according to the second embodiment. The echo-cancelling method may be applied with an electronic device, for example the electronic device 1 of FIG. 1. The electronic device is to generate an analog output signal and an external reference signal according to a first digital sound signal, and to generate an output audio according to the analog output signal.

The echo-cancelling method includes the steps 201-219. Step 201 is providing an audio I/O terminal. Step 203 is receiving the external reference signal of the electronic device via the audio I/O terminal. Step 205 is receiving an input audio and the output audio, which is transmitted from the electronic device. Step 207 is generating an analog input signal with the input audio and the output audio. Step 209 is receiving the analog input signal. Step 211 is generating a digital input signal according to the analog input signal. Step 213 is delaying the digital input signal to form a delayed digital input signal. Step 215 is receiving the delayed digital input signal. Step 217 is cancelling the output audio delivered from the electronic device according to the delayed digital input signal and the external reference signal then generating a second digital sound signal. Step 219 is transmitting the second digital sound signal to the electronic device via the audio I/O terminal.

In addition to the steps, the echo-cancelling method of the second embodiment can be performed to the operations and corresponding functions of the echo-cancelling device described in the first embodiment.

Figure 3:
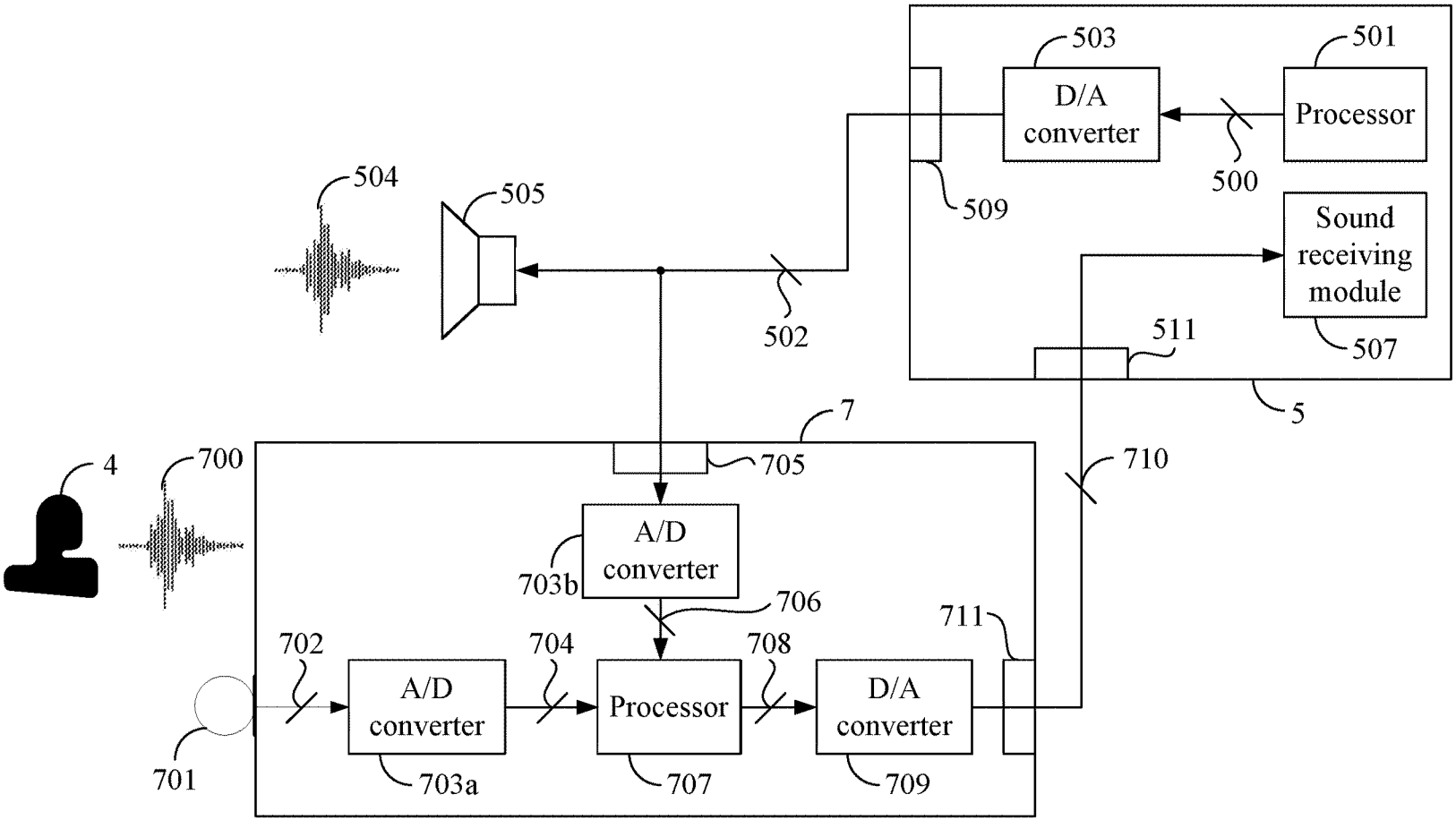
FIG. 3 is a schematic diagram showing an echo-cancelling device applied with an electronic device according to a third embodiment of the invention.

FIG. 3 is a schematic diagram showing an echo-cancelling device 7 electrically connected to an electronic device 5. The electronic device 5 includes a processor 501, a D/A converter 503, a speaking module 505, a sound-receiving module 507, an audio output terminal 509 and an audio input terminal 511. The processor 501 is electrically connected to the D/A converter 503. The D/A converter 503 is electrically connected to the speaking module 505 via the audio output terminal 509. The electronic device 5 may be a smart phone, a PDA, a desktop, a laptop or a television. The audio output terminal 509 may be a bana output terminal, a 2.5 mm TRS output terminal, a 3.5 mm TRS output terminal, a 6.35 mm TRS output terminal, a RCA output terminal or any analog signal transmission with the same function and well known to those skilled in the art. The audio input terminal 511 may be a bana input terminal, a 2.5 mm TRS input terminal, a 3.5 mm TRS input terminal, a 6.35 mm TRS input terminal, a RCA input terminal or any analog signal transmission with the same function and well known to those skilled in the art.

Referring to FIG. 3, the echo-cancelling device 7 according to the third embodiment includes an audio-receiving module 701, two A/D converters 703*a* and 703*b*, an audio input terminal 705, a processor 707, a D/A converter 709 and an audio output terminal 711. The audio-receiving module 701 is electrically connected to the A/D converter 703*a*. The processor 707 is electrically connected to the A/D converters 703*a*, 703*b* and the D/A converter 709. The audio output terminal 711 of the echo-cancelling device 7 is electrically connected to the audio input terminal 511 of the electronic device 5. In other words, the echo-cancelling device 7 is electrically connected to the electronic device 5 via the audio output terminal 711 and the audio input terminal 511. The audio-receiving module 701 may be a microphone or any sound capturing with the same function and well known to those skilled in the art. The audio output terminal 711 may be a bana output terminal, a 2.5 mm TRS output terminal, a 3.5 mm TRS output terminal, a 6.35 mm TRS output terminal, a RCA output terminal or any analog signal transmission with the same function and well known to those skilled in the art. The audio input terminal 705 may be a bana input terminal, a 2.5 mm TRS input terminal, a 3.5 mm TRS input terminal, a 6.35 mm TRS input terminal, a RCA input terminal or any analog signal transmission with the same function and well known to those skilled in the art.

The operating procedure of the electronic device 5 is described as following. Referring to FIG. 3, a first digital sound signal 500 is generated by the processor 501 when a sound is delivered from the electronic device 5, and then the first digital sound signal 500 is transmitted to the D/A converter 503. An analog output signal 502 is generated according to the first digital sound signal 500 when the D/A converter 503 receives the first digital sound signal 500, and then the analog output signal 502 is transmitted to the speaking module 505 via the audio output terminal 509. At the same time, the analog output signal 502 is transmitted to the echo-cancelling device 7 by the D/A converter 503 via the audio output terminal 509. Finally, the speaking module 505 generates an output audio 504 according to the analog output signal 502.

The operating procedure of a user 4 using the echo-cancelling device 7 to transmit the sound to the electronic device 5 is described as following. Referring to FIG. 3, when the user 4 generates an input audio 700, the audio-receiving module 701 receives the input audio 700 and the output audio 504, which is generated by the speaking module 505, simultaneously so as to generate an analog input signal 702 with the input audio 700 and the output audio 504. The analog input signal 702 is transmitted to the A/D converter 703*a*. It should be noted, the analog input signal 702 further has other noise including background audio.

The A/D converter 703*a* is to receive the analog input signal 702, and to generate a digital input signal 704 according to the analog input signal 702, and then the digital input signal 704 is transmitted to the processor 707. The A/D converter 703*b* is to receive the analog output signal 502 from the audio output terminal 509 of the electronic device 5 via the audio input terminal 705, and to generate an external reference signal 706 according to the analog output signal 502, and then the external reference signal 706 is transmitted to the processor 707. The processor 707 is to receive the digital input signal 704 and the external reference signal 706, and to cancel the output audio 504 according to the digital input signal 704 and the external reference signal 706 so as to generate a second digital sound signal 708, and then the second digital sound without the output audio 504 is transmitted to the D/A converter 709.

The D/A converter 709 receives the second digital sound signal 708 without the output audio 504 to generate an analog sound signal 710 without the output audio 504 according to the second digital sound signal 708. Wherein the analog sound signal 710 is transmitted to the electronic device 5 via the audio output terminal 711. Finally, the sound-receiving module 507 of the electronic device 5 receives the analog sound signal 710 from the audio output terminal 711 of the echo-cancelling device 7 via the audio input terminal 511.

In other embodiment, the D/A converter 709 may be an unnecessary element. In other words, the second digital sound signal generated by the processor of the echo-cancelling device can be transmitted to the audio input terminal of the electronic device via the audio output terminal directly.

Figure 4:
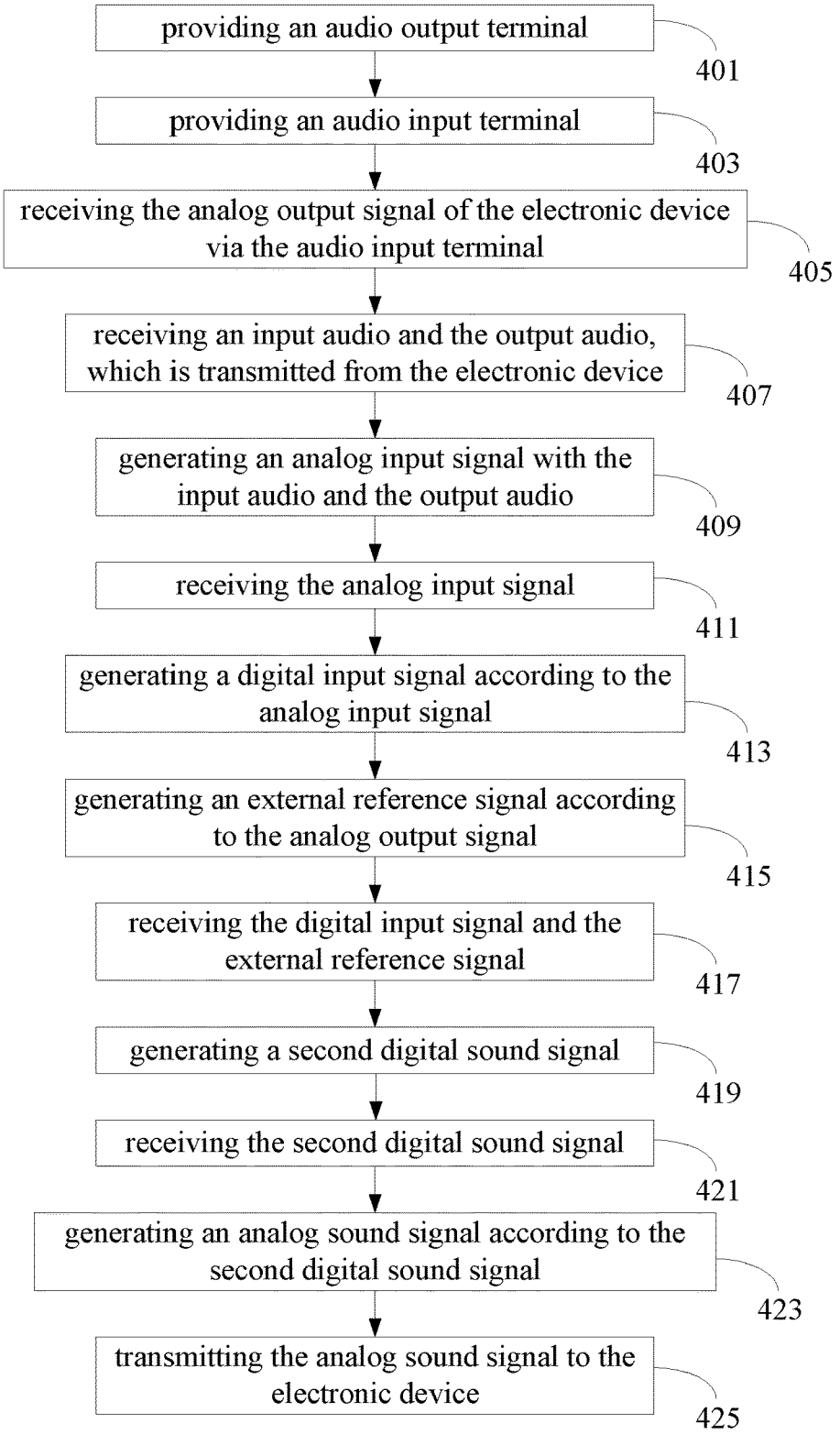
FIG. 4 is a flow chart showing an echo-cancelling method according to a fourth embodiment of the invention.

FIG. 4 is a flow chart showing the echo-cancelling method according to the fourth embodiment. The echo-cancelling method may be applied with an electronic device, for example the electronic device 5 of FIG. 3. The electronic device is to generate an analog output signal according to a first digital sound signal, and to generate an output audio according to the analog output signal.

The echo-cancelling method includes the steps 401-425. Step 401 is providing an audio output terminal. Step 403 is providing an audio input terminal. Step 405 is receiving the analog output signal of the electronic device via the audio input terminal. Step 407 is receiving an input audio and the output audio, which is transmitted from the electronic device. Step 409 is generating an analog input signal with the input audio and the output audio. Step 411 is receiving the analog input signal. Step 413 is generating a digital input signal according to the analog input signal. Step 415 is generating an external reference signal according to the analog output signal. Step 417 is receiving the digital input signal and the external reference signal. Step 419 is cancelling the output audio delivered from the electronic device according to the digital input signal and the external reference signal then generating a second digital sound signal. Step 421 is receiving the second digital sound signal. Step 423 is generating an analog sound signal according to the second digital sound signal. Step 425 is transmitting the analog sound signal to the electronic device via the audio output terminal.

In addition to the steps, the echo-cancelling method of the fourth embodiment can be performed to the operations and corresponding functions of the echo-cancelling device described in the third embodiment.

As mentioned above, the echo-cancelling device and the echo-cancelling method is an external connection type device to connect to the electronic device. The echo-cancelling device generates the sound signal, which is obtained by calculating the input audio, output audio and the external reference signal, to transmit to the electronic device. Therefore, the users may cancel the echo phenomenon without to modify the conventional electronic device.

Therefore, the echo-cancelling device and the echo-cancelling method can solve the echo phenomenon without to modify the conventional electronic device.

Even though numerous characteristics and advantages of certain inventive embodiments have been set out in the foregoing description, together with details of the structures and functions of the embodiments, the disclosure is illustrative only. Changes may be made in detail, especially in matters of arrangement of parts, within the principles of the present disclosure to the full extent indicated by the broad general meaning of the terms in which the appended claims are expressed.

What is claimed is:

1. An echo-cancelling device, which is electrically and externally connected to an electronic device, wherein an output signal and an external reference signal are generated by the electronic device according to a first sound signal, and an output audio is generated by the electronic device according to the output signal, comprising:

an audio input-output (I/O) terminal selected from a universal serial bus (USB) terminal, a high definition multimedia interface (HDMI) terminal, a Thunderbolt terminal, an IEEE 1394 terminal or a PCI Express terminal, being electrically and externally connected to the electronic device to receive the external reference signal from the electronic device;

an audio-receiving module receives an input audio and the output audio, and generates an analog input signal with the input audio and the output audio;

an analog-to-digital (A/D) converter is electrically connected to the audio-receiving module to receive the analog input signal and generates a digital input signal according to the analog input signal; and a processor is electrically connected to the A/D converter and the audio I/O terminal to receive the external reference signal via the audio I/O terminal and receive the digital input signal from the A/D converter so as to cancel the output audio and generate a second sound signal, which is transmitted to the electronic device via the audio I/O terminal.

2. The echo-cancelling device according to claim 1, wherein the first sound signal is a first analog sound signal or a first digital sound signal.

3. The echo-cancelling device according to claim 1, wherein the second sound signal is a second analog sound signal or a second digital sound signal.

4. The echo-cancelling device according to claim 1, further comprising:

a buffer memory, which is electrically connected between the A/D converter and the processor, receives and delays the digital input signal to form a delayed digital signal, and transmits the delayed digital signal to the processor.

5. An echo-cancelling device, which is electrically and externally connected to an electronic device, wherein an output signal is generated by the electronic device according to a first sound signal, and an output audio is generated by the electronic device according to the output signal, comprising:

an audio output terminal selected from a bana terminal, a 2.5 mm TRS terminal, a 3.5 mm TRS terminal, a 6.35 mm TRS terminal or a RCA terminal, being electrically and externally connected to the electronic device;

an audio input terminal selected from the bana terminal, the 2.5 mm TRS terminal, the 3.5 mm TRS terminal, the 6.35 mm TRS terminal or the RCA terminal, being electrically and externally connected to the electronic device to receive the output signal from the electronic device;

an audio-receiving module receives an input audio and the output audio, and generates an analog input signal with the input audio and the output audio;

at least an analog-to-digital (A/D) converter is electrically connected to the audio-receiving module and the audio input terminal to receive the analog input signal and the output signal, and to generate a digital input signal and an external reference signal according to the analog input signal and the output signal, respectively;

a processor is electrically connected to the A/D converter to receive the digital input signal and the external reference signal so as to cancel the output audio and generate a second sound signal according to the digital input signal; and a digital-to-analog (D/A) converter, which is electrically connected to the processor and the audio output terminal to receive the second sound signal so as to generate an analog sound signal for transmitting to the electronic device via the audio output terminal.

6. The echo-cancelling device according to claim 5, wherein the first sound signal is a first analog sound signal or a first digital sound signal.

7. The echo-cancelling device according to claim 5, wherein the second sound signal is a second analog sound signal or a second digital sound signal.

8. An echo-cancelling method applied with an electronic device, wherein the electronic device generates an output signal and an external reference signal according to a first sound signal, and generates an output audio according to the output signal, comprising:

receiving the external reference signal via an audio input-output (I/O) terminal which is electrically and externally connected to the electronic device and selected from a universal serial bus (USB) terminal, a high definition multimedia interface (HDMI) terminal, a Thunderbolt terminal, an IEEE 1394 terminal or a PCI Express terminal;

receiving an input audio and the output audio;

generating an analog input signal with the input audio and the output audio;

receiving the analog input signal;

generating a digital input signal according to the analog input signal;

receiving the digital input signal;

cancelling the output audio according to the digital input signal and the external reference signal;

generating a second sound signal; and transmitting the second sound signal to the electronic device via the audio I/O terminal.

9. The echo-cancelling method according to claim 8, further comprising the following steps:

delaying the digital input signal to form a delayed digital input signal; and transmitting the delayed digital input signal.

10. An echo-cancelling method applied with an electronic device, wherein the electronic device generates an output signal according to a first sound signal, and generates an output audio according to the output signal, comprising:

receiving the output signal via an audio input terminal which is electrically and externally connected to the electronic device and selected from a bana terminal, a 2.5 mm TRS terminal, a 3.5 mm TRS terminal, a 6.35 mm TRS terminal or a RCA terminal;

receiving an input audio and the output audio;

generating an analog input signal with the input audio and the output audio;

receiving the analog input signal;

generating a digital input signal according to the analog input signal;

generating an external reference signal according to the output signal;

cancelling the output audio according to the digital input signal and the external reference signal;

generating a second sound signal;

receiving the second sound signal;

generating an analog sound signal according to the second sound signal; and transmitting the analog sound signal to the electronic device via an audio output terminal which is electrically and externally connected to the electronic device and selected from the bana terminal, the 2.5 mm TRS terminal, the 3.5 mm TRS terminal, the 6.35 mm TRS terminal or the RCA terminal.

* * * * *